United States Patent [19]

Mourier

[11] 4,035,688

[45] July 12, 1977

[54] ELECTRONIC TUNABLE MICROWAVE DEVICE

[75] Inventor: Georges Mourier, Paris, France

[73] Assignee: Thomson-CSF, Paris, France

[21] Appl. No.: 667,463

[22] Filed: Mar. 16, 1976

[30] Foreign Application Priority Data

Mar. 21, 1975 France ..... 75.08942

[51] Int. Cl.[2] ..... H01J 7/46; H01J 19/80

[52] U.S. Cl. ..... 315/39; 313/103 R; 315/39.51; 315/39.55; 333/99 MP

[58] Field of Search ..... 315/39, 39.51, 39.55; 313/103, 105; 333/99 MP

[56] References Cited

U.S. PATENT DOCUMENTS

| | | | |
|---|---|---|---|
| 2,674,694 | 4/1954 | Baker | 313/103 X |
| 2,856,518 | 10/1958 | Lerbs | 333/99 MP |
| 2,925,528 | 2/1960 | Hartnell-Beavis | 313/103 X |
| 3,078,424 | 2/1963 | Carter et al. | 333/99 MP |
| 3,348,169 | 10/1967 | Tomiyasu | 313/103 X |
| 3,354,349 | 11/1967 | Horn | 333/99 MP |
| 3,748,592 | 7/1973 | Pickering | 333/99 MP |

*Primary Examiner*—Saxfield Chatmon, Jr.
*Attorney, Agent, or Firm*—Roland Plottel

[57] ABSTRACT

A device for providing a tunable impedance due to variations of a multipactor discharge; the device of the invention gives rise to low insertion losses when incorporated in another device, due to particular structure provides a longitudinal drift of the electrons of the discharge which thus have an elongated trajectory before stricking an electrode.

10 Claims, 7 Drawing Figures

ELECTRONIC TUNABLE MICROWAVE DEVICE

This invention relates to a microwave device whose impedance can be varied electronically in a simple and rapid manner. The invention also concerns use of such devices in electronic systems whose impedance is required to vary for reasons such as switching the power of a radar system between a number of channels, providing phase variations, e.g. for electronic scanning, and providing frequency control of magnetrons.

Various kinds of tunable-impedance microwave devices are known but the only ones of interest here are those whose impedance can be varied by electronic control, since electronic control is the only way of producing a rapid variation in the manner necessary in the various uses just referred to. Some of these known electronically controlled devices use some resonance properties of gas discharges and, in particular, some of such known devices use the phenomenon of "multipactor effect".

Such multipactor effect devices, sometimes referred to as multipactor diodes, comprise two plane, parallel and facing diodes disposed in a hermetic vacuum chamber, the two electrodes being adapted to emit secondary electrons at a relatively high factor when bombarded by primary electrons. To produce a multipactor discharge a microwave electromagnetic field whose half-period is equal to the electron transit time between the two electrodes is produced therebetween. The multipactor discharge originates and is stabilized between the two electrodes and is equivalent to an appreciable conductance therebetween. The steady discharge can be interrupted, together with the low impedance corresponding to such discharge, by inhibiting one of the stability conditions, e.g. by applying an appropriate d.c. voltage between the two electrodes, in which event an on/off control is provided. The low impedance between the two electrodes of a multipactor diode can be varied continuously, to provide a continuously variable impedance, just by varying the strength of such discharge without stopping the same; one way of providing such a control is to apply an appropriate d.c. voltage between the two electrodes to provide a slight modification of the electron transit time therebetween but without stopping the discharge.

Multipactor diodes of the king described have already been used as electronically variable impedances. The Applicant's U.S. patent application Ser. No. 535.715 of 23 Dec. 1974, now U.S. Pat. No. 3,967,155, describes one use of such diodes.

A considerable advantage of these multipactor discharge adjustable impedances is that such discharges are more stable than ordinary discharges. Unfortunately, impedances which can be varied by discharge have a serious disadvantage in that such impedances as offered by multipactor diodes introduce high inherent losses in the circuits with which they are used; theory shows that the admittance of such discharges has resistive and reactive components which are very close to one another.

The reason for such power losses is that when a multipactor discharge has reached stability, each electron admitted by one electrode strikes the other electrode with a fairly high kinetic energy of e.g. from 50 to 100 eV at the end of one half-wave of the high-frequency oscillation and is replaced by secondary electrons having a much smaller kinetic energy of approximately from 2 to 5 eV.

It is an object of the invention to provide variable-impedance microwave devices using multipactor discharges and having lower losses than the prior art devices as the result of special features of their electrodes.

There is provided, according to the invention, a microwave device of electronically variable impedance comprising, in a vacuum enclosure:

a multipactor device having two coaxial electrodes adapted to emit secondary electrons with a coefficient $\delta$ greater than unity ($\delta>1$), the inner electrode being closed at one of its ends by an electrical conducting wall, and the external electrode extending away from this closed end for providing an area of longitudinal drift for the electrons of the multipactor device such that when a high frequency electromagnetic energy is applied between said two electrodes, electrons of the discharge are moved away from the coaxial area towards the drift area;

and means for applying between said two electrodes a control voltage for varying the impedance of the device.

Other features, characteristics and results of the invention will become apparent from the following description taken together with the accompanying drawings wherein by way of example:

Figure 1:
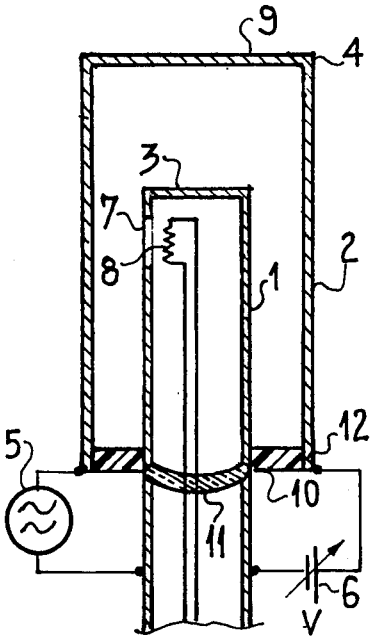
FIGS. 1 and 2 are diagrammatic sectioned views of examples of microwave devices according to the invention.

Referring to FIG. 1, two coaxial cylindrical electrodes 1, 2 are adapted to produce an improved multipactor discharge according to this invention when an appropriate microwave field is applied between them.

The inner electrode 1 is embodied by a cylindrical metal wall closed at its end 3. The outer electrode 2 is embodied by a cylindrical wall open at at least one, 12, of its two ends; the outer-electrode end 4 which corresponds to the inner-electrode end 3 can be either closed, as at 9 in FIG. 1, or open, in which event the metal wall 9 is absent. In all cases the end 4 is disposed beyond the end 3, electrode 2 being longer than electrode 1. The two electrodes 2, 1 are either made of, or covered on their facing surfaces with, a substance adapted to emit secondary electrons at a secondary-emission factor $\delta>1$, such as aluminium or alumina, beryllium copper or a platinum deposit, or the like; alternatively, such surfaces can be treated to have the property of having a secondary emission factor $\delta>1$.

Figure 3:
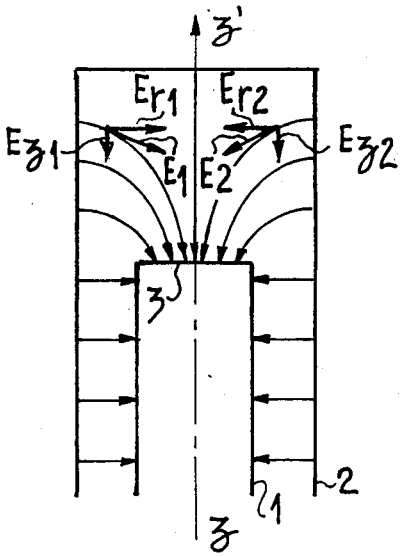
FIGS. 3 and 4 are diagrammatic representations of the field patterns in the devices shown in FIGS. 1 and 2.

When a high-frequency electromagnetic field, represented very symbolically by the reference 5, is applied between the two electrodes, an electric field E having the pattern shown in FIG. 3 is produced. In the bottom part of FIG. 3 where the electrodes are parallel, the electric field is uniform, but throughout the zone near the end 3 of inner electrode 1 and beyond end 3 the electric field is not uniform, the field lines bending and field strength decreasing in proportion as one moves further away from the inner-electrode end 3. The bending or curvature of the field lines results in the existence of a longitudinal component Ez parallel to the longitudinal axis of the electrodes.

Consequently, the electrons of the multipactor discharge produced between the two electrodes as a result of the application of the high-frequency energy 5 have, in addition to a radial displacement velocity as in a conventional multipactor discharge, a longitudinal component in their displacement velocity.

The longitudinal component of velocity changes direction at each change of direction of the field E - i.e., at each halfwave of the high-frequency energy; however, since the strength of the field E decreases in the positive direction of the axis $zz'$, the overall effect on the electrons is to produce a longitudinal drift tending to move the electrons away from the end 3 -i.e., in the positive direction of the axis $zz'$. This movement of the electrons towards regions of low electric field is in any case a physical property of electron gases which is known per se and which has been studied inter alia by BOOT, WEIBEL, GAPONOV and MILLER.

Consequently, the electrons of the multipactor discharge, since they are drawn towards regions of low field strength, are retained in the discharge for longer than one half-wave of the high-frequency energy and losses are reduced, each electron making a number of oscillations before striking one of the two electrodes towards which the radial component of the electric field forces it.

To vary the impedance of such a device, a d.c. voltage V symbolized by the reference 6 in FIG. 1 is applied between the two electrodes in a manner which is known per se and which has already been described e.g. in the previously mentioned Patent Application. The control can be of the on/off kind, as previously stated in connection with the prior art, the discharge either existing or not existing according to one of two values of V.

If required, a progressive control can be used. When the control voltage V of a multipactor diode is varied progressively, the transit time of the electrons participating in the discharge is modified artificially, the modification leading to variations in the relative phase of the emitted electrons and of the high-frequency wave, the condition: transit time = half-period of the high frequency wave, being no more fulfilled. There is therefore a progressive variation of the impedance of the discharge - i.e., of the impedance between the two electrodes 1 and 2.

In FIG. 1 there can be seen an aperture 7 in the cylindrical wall of the electrode 1 and an electron-emitting filament 8 so disposed opposite aperture 7 as to emit electrons therethrough when heated, for in devices according to the invention there should be an electron source upstream of the region in which the electrons of the discharge drift, to compensate for such drift and to ensure that the discharge can retain a constant strength for a constant value of V. These initial electrons may be present only in a very reduced number, due to their immediate multiplication by secondary emission. They can be produced, by a filament, as in FIG. 1 or by a small local cathode disposed in the wall of electrode 1 (at the site of the aperture 7) or by a small radioactive source disposed in electrode 1 near a thin wall, radiation from such source removing electrons from electrode 1.

Such a device must be in a vacuum enclosure for operating. When the device is required to form part of a microwave device which is itself a vacuum device (e.g. as in FIG. 7), the device itself need not be hermetic on its own. However, when the device is placed in some other not vacuum device, the device according to the invention must be sealed and must have an internal vacuum. This is represented diagrammatically by an insulating ring 10 and a glass wall 11 through which wires for heating the emitting filament 8 are led. If the end 4 of electrode 1 is not closed by the metal wall 9, closure must be provided e.g. by a hermetic disc made of an insulating material.

Figure 2:
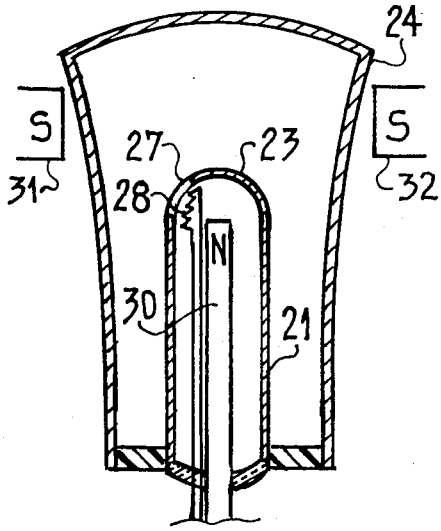
Figure 4:
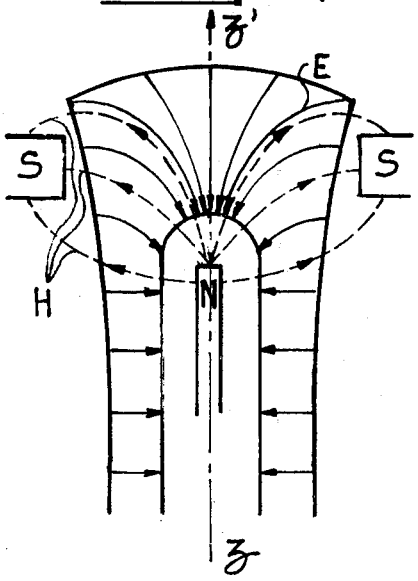

FIGS. 2 and 4 show a variant in which the shape of the electrodes 21, 22 differs slightly from the previous embodiment, end 23 of electrode 21 being rounded instead of flat while the corresponding end 24 of electrode 22 flares. The lines of the electric field E therefore have a slightly different pattern leading to a slightly more marked electron drift effect.

This variant also comprises a system of magnets which are shown diagrammatically at 30, 31, 32 and which are adapted to produce between the two electrodes a non-uniform continuous magnetic field H as indicated by magnetic field lines H in FIG. 4. Field H diverges and decreases in strength as it is further away from the inner electrode 21 and further accentuates the longitudinal electron drift effect. This property is also a known property of electron gases; an electron gas immersed in a continuous magnetic field is dismagnetic and moves towards regions of low magnetic field strength.

Of course, the polarity of the magnetic field H can be reversed and the same can be an additional feature in the device shown in FIG. 1.

Figure 5:
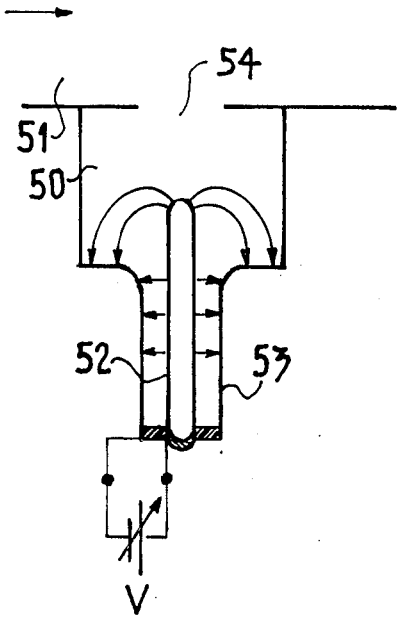
FIGS. 5 to 7 are examples showing how the devices according to the invention are of use for a cavity, a wave guide and a magnetron, respectively.
Figure 6:
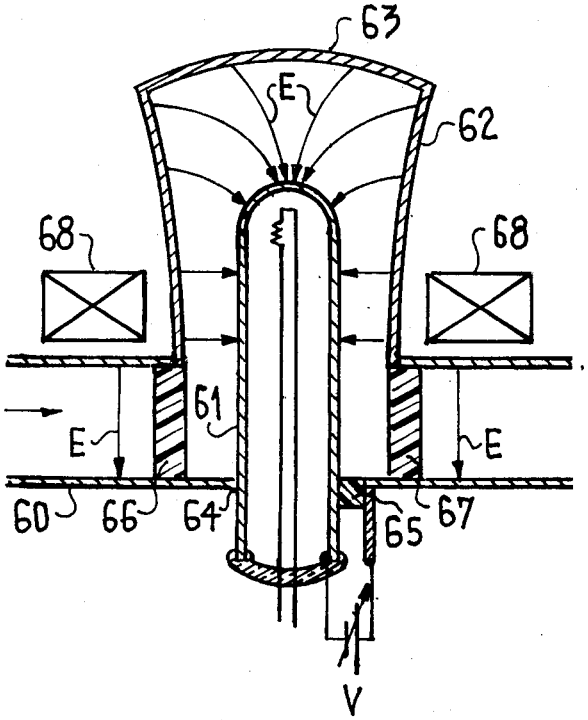
Figure 7:
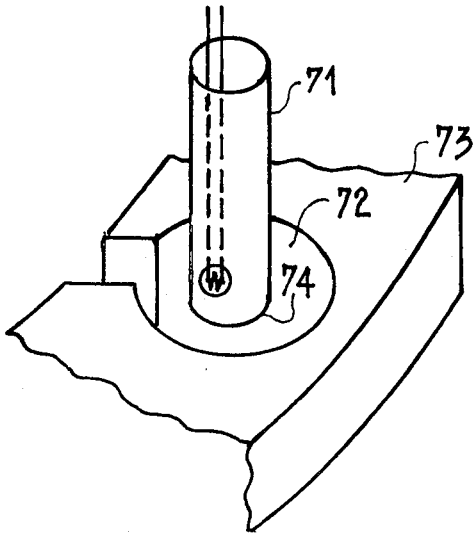

FIGS. 5–7 show by way of example three possible uses of devices according to the invention.

Referring to FIG. 5, a device according to the invention is associated with a cavity 50 coupled with a wave guide 51 in which high-frequency energy travels in the direction indicated by an arrow. It is known to modify the propagation of energy in a wave guide by modifying the resonant frequency $F_o$ of a cavity coupled with the wave guide, e.g. to provide attenuation or a phase shift varying in dependance on $F_o$.

If a device according to the invention is placed in the cavity 50 and if the d.c. voltage V between its electrodes 52 and 53 is varied, the cavity is provided with a variable impedance which varies its resonant frequency but produce only slight insertion losses.

In this case the high-frequency electromagnetic field is applied between the electrodes in a very simple manner. The inner electrode 52 is insulated from the cavity wall whereas the outer electrode 53 is connected thereto. The element providing sealing-tightness of the top part of the device is not shown in FIG. 5 and can be disposed e.g. near the coupling orifice 54, so that the complete system embodied by the cavity and the device according to the invention is a vacuum system.

FIG. 6 is a diagrammatic view of a device according to the invention which is disposed in a vacuum chamber and which extends through a wave guide 60 in which a high-frequency energy is being propagated.

The variable-impedance device is equivalent to the device shown in FIG. 2. Outer electrode 62 is connected to one of the major surfaces of the guide 60 and is closed at its end 63 by an e.g. metal wall; electrode 62 forms an electrical continuation of that major surface of the guide to which it is connected. Inner electrode 61 is connected at the place 64 to the other major surface of the wave guide, electrode 61 continuing the latter surface. At its other end the inner electrode 61 is isolated by an electrically insulating and vacuum-tight member 65 which enable the d.c. control voltage V to be applied between electrodes 61 and 62 and provides satisfactory insulation of the d.c. voltages, the positive side of the source V being e.g. at earth potential. The device is made hermetic by two isolating members 66, 67 which prevent any communication between the device and the wave guide. A winding 68 around the electrode 62 produces in the interior thereof a magnetic field H of the kind shown in FIG. 4. The magnetic field, which is non-uniform and divergent in the zone where the electric field E is not uniform, is a factor, as hereinbefore described, in the drift of the discharge electrons.

It is a simple matter to apply the microwave field between the two electrodes since the inter-electrode space continues the internal space of the guide.

FIG. 7 is a view in very diagrammatic form showing the use of a device according to the invention with a magnetron cavity, since it is well known that the oscillation frequency of a magnetron can be varied by varying the impedance of one or more of its cavities; for instance, this feature was described in the aforesaid patent application of the Applicants. Such a variation is very simple to devise by using one or more devices according to this invention disposed in one or more, respectively, magnetron cavities.

It is very simple matter in such a case to realise the variable-impedance devices, for since the inside of the magnetron is in vacuo, the devices do not have to be sealed separately.

An inner electrode 71 extends a few millimetres into a cylindrical cavity 72 of anode 73 of a magnetron. The cylindrical wall of cavity 92 serves as the outer electrode of the multipactor diode provided that the surface of the latter wall is treated to have a secondary emission factor $\delta>1$. The electromagnetic field is applied automatically between the two electrodes since it is present in the cavity, the inner electrode 71 serving as earth for high-frequency purposes.

The electrode 71 can e.g. be secured to one of the cheeks of the magnetron. Electrode 71 is electrically insulated from the magnetron, being secured thereto by an insulting member, so that it can be given a d.c. potential V different from the reference potential or earth of the magnetron system; the potential V serves to control the impedance variations of the discharge, the varying impedance modifying the impedance of the cavity 72.

The pole-pieces providing the magnetic field necessary for the operation of a magnetron are so arranged that such field is not completely uniform and, as hereinbefore described, is a factor in the electron drift of the multipactor discharge.

What is claimed is:

1. A microwave device of electronically variable impedance comprising, in a vacuum enclosure:

a multipactor device having two coaxial electrodes defining between them a multipactor space when a high frequency electromagnetic energy is applied there between and adapted to emit secondary electrons with a coefficient $\delta$ greater than unity ($\delta>1$), the inner electrode being closed at one of its ends by an electrical conducting wall, and the external electrode extending away from this closed end in such a way that said multipactor space comprises a region of uniform high frequency electric field and a further region of non uniform high frequency electric field, thus providing in said further region an area of longitudinal drift for the electrons of the multipactor device such that, electrons of the discharge are moved away from the region of uniform electric field towards the further region; and means for applying between said two electrodes a control voltage for varying the impedance of the device.

2. A device according to claim 1, wherein the inner electrode has an electron source disposed near the closed end of the inner electrode on the wall opposite the outer electrode.

3. A device according to claim 2, wherein the inner electrode is hollow and the electron source takes the form of an aperture in the inner-electrode wall and of a heated electron-emitting filament disposed in the inner electrode opposite the aperture.

4. A device according claim 1, wherein the outer electrode is cylindrical at the end remote from the closed end of the inner electrode and flares at its other end.

5. A microwave device of electronically variable impedance comprising, in a vacuum enclosure:

a multipactor device having two coaxial electrodes defining between them a multipactor space when a high frequency electromagnetic energy is applied therebetween and adapted to emit secondary electrons with a coefficient $\delta$ greater than unity ($\delta>1$), the inner electrode being closed at one of its ends by an electrical conducting wall, and the external electrode extending away from this closed end in such a way that said multipactor space comprises a region of uniform high frequency electric field and a further region of nonuniform high frequency electric field, thus providing in said further region an area of longitudinal draft for the electrons of the multipactor device such that electrons of the discharge are moved away from the region of uniform electric field towards the further region;

means for applying between said two electrodes a control voltage for varying the impedance of the device; and means for producing a non-uniform continuous magnetic field, said means being so disposed that the magnetic field applied to the device decreases along the direction of the longitudinal axis of the two electrodes and towards the closed end of the inner electrode — i.e., the corresponding end of the outer electrode.

6. A device according to claim 5, wherein a first magnetic member is disposed in the inner electrode which is hollow one, said magnetic member having a first kind of polarity near the closed end of the inner electrode; and the other magnetic member is disposed around that end of the outer electrode which corresponds to the closed end of the inner electrode, said other magnetic member having a second kind of polarity around the outer electrode.

7. A device according to claim 5, wherein a winding flowed through by a direct current is disposed around the outer electrode near the closed end of the inner electrode, the longitudinal axis of the device coinciding with the longitudinal axis of said winding.

8. A variable-impedance resonant cavity, comprising a device according to claim 1 disposed in an aperture in one of the cavity walls, the longitudinal axis of said device being perpendicular to said wall, the outer electrode of said device being electrically connected to said wall, and the inner electrode of said device extending into said cavity.

9. A wave guide comprising a device according to claim 1 disposed in an aperture in the two largest faces of the guide, the longitudinal axis of said device being perpendicular to said faces; the outer electrode of said device is electrically connected to one of said faces; and the inner electrode is electrically connected to the other of said faces, so that the electromagnetic field travelling in the wave guide appears between the two electrodes, the electrical component of the field being perpendicular thereto.

10. A tunable-frequency cylindrical-cavities magnetron comprising in at least one of its cavities, a device according to claim 1, the outer electrode of said device being constituted by the cylindrical wall of said cavity, and the inner electrode extending in part into said cavity.

* * * * *